United States Patent [19]

Seymour et al.

[11] 4,143,429

[45] Mar. 13, 1979

[54] VANITY AND LAVATORY ASSEMBLY

[75] Inventors: Merritt W. Seymour, Sylvania; James E. Jones, Toledo, both of Ohio

[73] Assignee: Owens-Corning Fiberglas Corporation, Toledo, Ohio

[21] Appl. No.: 881,209

[22] Filed: Feb. 27, 1978

Related U.S. Application Data

[63] Continuation of Ser. No. 618,586, Oct. 1, 1975, abandoned.

[51] Int. Cl.[2] ..... E03C 1/322; E03C 1/33; A47K 1/04

[52] U.S. Cl. ..... 4/170; 4/187 R; 52/35; 248/250

[58] Field of Search ..... 4/173 R, 177, 2-5, 4/187 R, 187 A, 166, 170; 52/27, 35, 36; 312/228; 248/235, 247, 250

[56] References Cited

U.S. PATENT DOCUMENTS

| | | | |
|---|---|---|---|
| 2,906,487 | 9/1959 | Simon | 248/250 X |
| 3,101,486 | 8/1963 | Tiller | 4/170 |
| 3,364,503 | 1/1968 | Mustee | 4/170 |
| 3,824,636 | 7/1974 | Brown | 4/170 X |
| 3,975,781 | 8/1976 | Klimboff | 4/187 A X |

*Primary Examiner*—Stuart S. Levy

*Attorney, Agent, or Firm*—Ronald C. Hudgens; Greg Dziegielewski

[57] ABSTRACT

A wall mounted vanity and lavatory assembly positioned between two opposed walls of a room where the assembly contains a vanity member having a lavatory located therein. The vanity member also contains a support portion and an attachment portion located at each end of the vanity member. Secured on each of the opposed walls is a mounting bracket where the mounting bracket contains a support surface and an attachment surface. The vanity member is positioned on the mounting bracket so that the support portion of the vanity member is in engagement with the support surface of the mounting bracket to provide vertical support for the vanity member. The attachment portion of the vanity member is securely attached to the attachment surface of the mounting bracket to hold the vanity member in position between the opposed walls.

7 Claims, 7 Drawing Figures

VANITY AND LAVATORY ASSEMBLY

This is a continuation, of application Ser. No. 618,586, filed Oct. 1, 1975, now abandoned.

BACKGROUND OF THE INVENTION

This invention relates to a vanity and lavatory assembly that can be positioned between two opposed walls of a room. The assembly contains a vanity member that has a lavatory located therein and a section on the vanity member that can be used to support the vanity between two opposed walls. A mounting bracket having a support surface secured to each of the opposed walls so that the support surface of the mounting bracket can be used to support the vanity member. The mounting bracket is designed so that the vanity member can be easily positioned between the two opposed walls and so that the vanity member can be easily removed from its location between the two opposed walls. There is also a removably mounted securement means that is used to secure the vanity member in position on the mounting bracket so that the vanity member will be securely held in place on the mounting bracket.

In the past vanities have been constructed so that after installation, they become a permanent part of the room in which they are located. This was accomplished by building the vanity so that it is extended from the structural members or studs of one wall over to the structural members of the opposed wall and usually was similarly affixed to the structural members of the wall situated adjacent to and at 90° to said opposed walls.

Another disadvantage of the traditional vanity is that since it is permanently affixed as a part of the room, it is difficult to remove for repair and replacement in case of damage.

Therefore, it would be very desirable to have a vanity unit having the lavatory contained therein that can be easily mounted between opposed finished walls in a room. There is also a need for a vanity that can be easily removed and replaced so that the decor in the bathroom of a commercial establishment such as a hotel or motel can be easily and relatively inexpensively changed. The removable feature of the vanity could also be utilized to improve the access to the plumbing for the lavatory in the vanity, allowing installation and/or repair of the plumbing fittings in a convenient location away from the room in which the vanity is installed. This resulted in a vanity that was very securely attached to the walls of the room. Then the lavatory, drawers or any other additional features were added to the vanity and frequently these additional features created a vanity that extended to the floor and that was secured to the floor. Or as an alternative to this systems pre-assembled vanity that extended from the floor to the desired height would be positioned between the studding or framing members of the room and this type of vanity would then be securely attached to the studding and to the floor or the room. Thus, the vanity was constructed so that it was a relatively permanent feature in the room. Once the vanity had been positioned the finished walls in the interior of the room could then be put in place so that they extended down to the edges of the vanity. At this time any additional finishing that was required on the vanity would also be completed. Thus, the walls of the room completely integrated the vanity into the structure of the room. It should be noted that this is a relatively expensive and time consuming process for installing a vanity, especially in a commercial application such as a hotel or motel where a large number of similar vanities are to be installed.

An additional problem with this type of traditional vanity is that it requires coordination between the plumbers and carpenters working on the room where the vanity is installed. In a normal installation the carpenters construct the rough walls in the room. The plumbers install the rough plumbing in the room when the rough walls are in place. Next the carpenters install the vanity and the plumber installs the lavatory once the vanity has been put in place. The carpenters then add the finished walls to the room and when this had been completed the plumbers return to install the finished plumbing. It is obvious, that to have this work done efficiently, the work of the carpenters and plumbers must be very well coordinated and scheduled. These coordination and scheduling problems are compounded when a large number of vanities have to be installed, such as in a hotel or motel. Therefore, this traditional vanity system can result in expensive delays and wasted time that further increases the cost of the vanity.

Since the vanities are so securely integrated into the structure of the room, it is very difficult to remove or replace the vanity. The finished interior walls around the vanity must be removed so that the vanity can be separated from the structural members or lumber of the room. Once this has been accomplished the vanity can be removed and another vanity secured in place and the finished walls around the vanity replaced or repaired. This type of replacement is a major project and it is not normally undertaken unless absolutely necessary. However, in large hotels and motels it is often desirable to remodel or change the decor of the room so that it remains attractive to the customers. The bathroom area is usually one place where this type of remodeling can drastically improve the appearance of the room. However, as previously discussed the vanities found in these rooms are usually very difficult to remove and replace. If this must be done on a large scale in all the rooms of a hotel or motel, it becomes a major remodeling project. Thus, most hotels and motels find this economically unattractive and they make due with their old vanities until they are forced to replace them. In some instances it is possible to remodel the vanity without removing it from the room and replacing it. However, to make any kind of a sufficient change in the vanity, it is usually necessary to make such drastic modifications that it is almost as expensive as completely removing the vanity.

SUMMARY OF THE INVENTION

An object of this invention is an improved vanity and lavatory assembly that can be positioned between two opposing walls of a room.

Another object of the invention is an improved mounting bracket for the vanity and lavatory assembly.

Yet another object of the invention is an improved vanity and lavatory assembly that is easier to install.

Additional objects of the invention in an improved vanity and lavatory assembly that is quicker to install.

Another object of the invention is an improved vanity and lavatory assembly that is easier to remove and replace.

In a broad sense these and other objects of the invention can be attained by a wall mounted vanity and lavatory assembly that can be positioned between two opposed walls of a room where the assembly has a vanity member that has a lavatory located therein. The vanity member also includes a support portion and an attachment portion that are located at each end of the vanity member. On each of the opposing walls the mounting bracket is secured where the mounting bracket includes a support surface. The support portion of the vanity member is then positioned on the support surface of the mounting bracket so that the support surface of the bracket will provide vertical support for the vanity member. The mounting bracket further includes an attachment surface upon which the attachment portion of the vanity member is securely attached so that the vanity member will be held in position between the opposed walls.

Other objects and advantages of the invention will become apparent as the invention is described hereinafter in more detail with reference made to the accompanying drawings.

DESCRIPTION OF THE PREFERRED EMBODIMENTS

This invention relates to a vanity and lavatory assembly that is mounted between two opposed walls of the room. The vanity and lavatory assembly is mounted on brackets that are secured to each of the opposed walls of the room and the brackets provide the support that holds the assembly in position between the walls. The mounting bracket is designed so that the vanity and lavatory assembly can easily be installed between the walls and so that the vanity and lavatory assembly can also easily be removed once it has been put in position between the walls.

Figure 1:
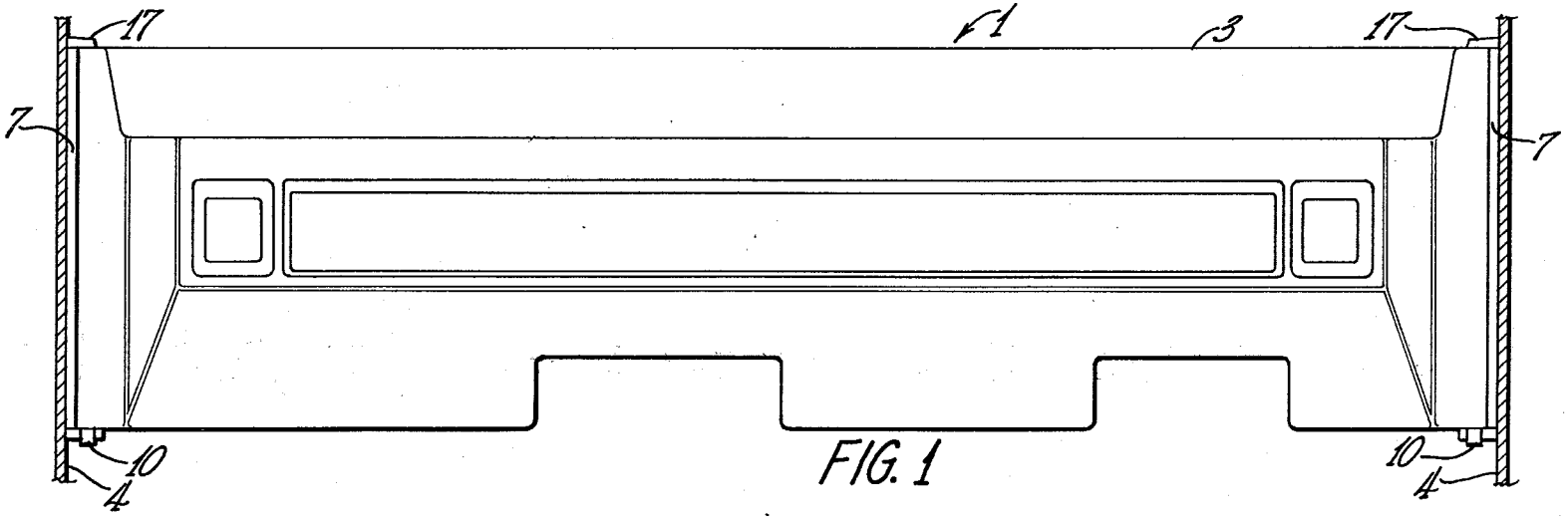
FIG. 1 is a front view of the vanity and lavatory assembly.
Figure 2:
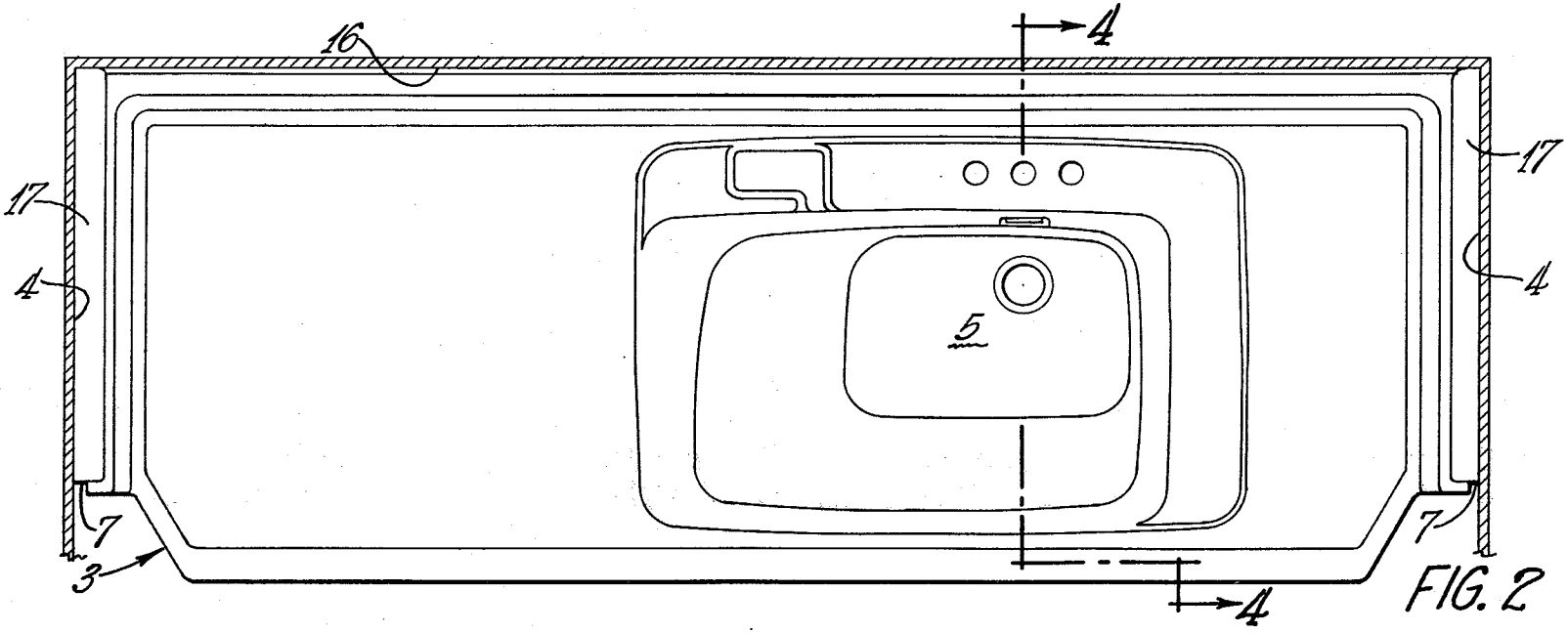
FIG. 2 is a top view of the vanity and lavatory assembly.

The details of this invention will be better understood by referring to the attached drawings. FIGS. 1 and 2 show the vanity and lavatory assembly as it is positioned on the mounting bracket between two opposed walls. As can be seen from the drawings the vanity and lavatory assembly 1 has a vanity member 3 that extends between the two opposed walls 4. The vanity member 3 is supported between the two walls 4 by means of a mounting bracket 7 that is attached to each of the opposed walls of the room. The vanity member 3 contains a lavatory 5 located therein and the lavatory is already positioned in the vanity member when the vanity member is positioned upon the mounting bracket 7. The mounting bracket 7 is securely positioned to the opposing walls 4 by using nails, screws or other suitable fastening means which are driven through slots located in the mounting bracket into the walls. This type of attachment method for the mounting bracket 7 provides a very firm support that is capable of supporting the vanity and lavatory assembly between the walls during most normal uses. The vanity member 3 is positioned on the mounting bracket 7 so that the rear portion of the vanity member is in contact with the rear wall 16 of the room in which the vanity and lavatory assembly is positioned. For a good installation a relatively water tight seal should be made between the rear edge of the vanity member 3 and the rear wall 16 of the room. A suitable gasket can be provided on these edges to obtain the desired water tight seal. On the side of the vanity member 3 the upper surface or leg 17 of the mounting bracket 7 extends over the upper surface of the vanity member and a generally water tight seal should also be formed between the upper surface 17 of the bracket in the upper surface of the vanity member. Thus a snug and relatively water tight seal is provided around the rear and side edges of the vanity member. To hold the vanity and lavatory assembly 1 in position on the mounting bracket 7 an attachment means 10 is provided at each end of the vanity member for securing the vanity member in position on the mounting bracket. Once the vanity member 3 has been properly positioned and secured on the mounting bracket the finished plumbing for the lavatory can be connected to the rough plumbing that has already been installed. Once the plumbing is connected the vanity member will be ready for use.

Figure 3:
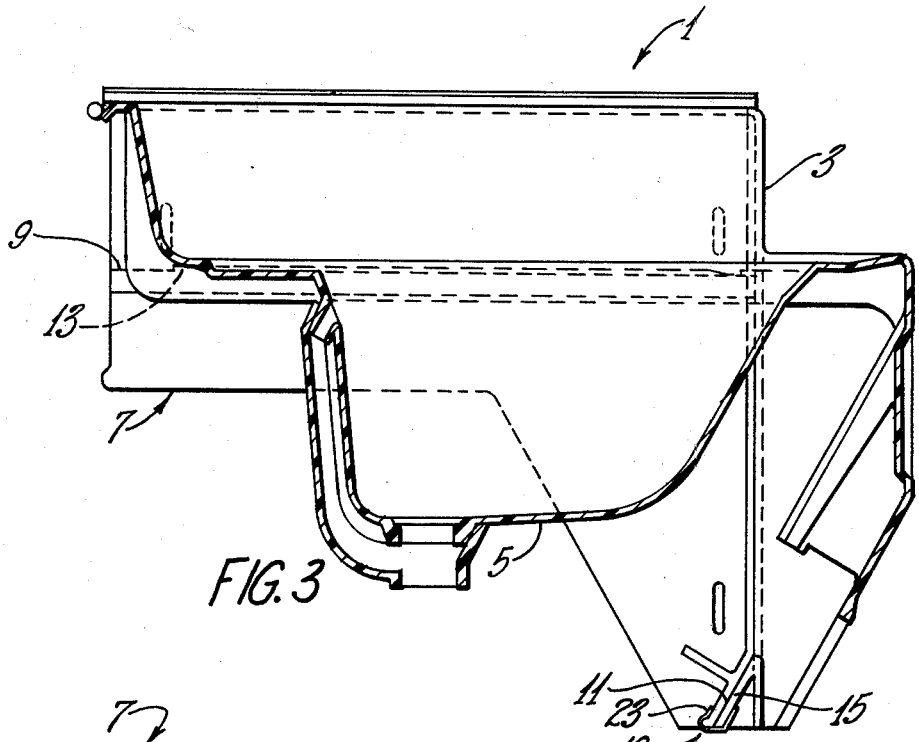
FIG. 3 is a cross sectional view of the vanity and lavatory assembly that shows the attachment means of the assembly.

The details of the attachment means 10 will be better understood by referring to FIG. 3. On the sides of the vanity member 3 there is an attachment portion 15 that is located in the lower region of the vanity member. The attachment portion 15 is securely connected to the side of the vanity member 3 so that a sturdy attachment portion is provided that will be capable of holding the vanity member in position on the mounting bracket. On the lower portion of the mounting bracket 7 there is located an attachment surface 11 and when the vanity member 3 is properly positioned on the mounting bracket 7 the attachment portion 15 of the vanity member 3 will be positioned against the attachment surface 11 on the mounting bracket 7. The attachment portion 15 and the attachment surface 11 are held in pressed relation by a spring clip 23 that fits over the bottom edge of the attachment portion 15 and the attached surface 11. The spring clip 23 should be designed so that it exerts enough force upon the attachment portion and the attachment surface to securely hold them together and to thus securely hold the vanity member 3 in position on the mounting bracket 7. As can be seen from the drawings the attachment means 10 is located behind the front wall of the vanity member 3 so that the attachment means 10 is relatively hidden from view when looking at the vanity and lavatory assembly. Although a spring clip has been shown as the securement means that holds the vanity and lavatory assembly in position on the mounting bracket it should be noted that other suitable securement means could be used. In addition the position and configuration of the attachment surface and attachment portion could be varied and the above system is only given as an example. The only requirement is that the attachment means be sturdy enough to hold the vanity member in position on the mounting brackets.

Figure 4:
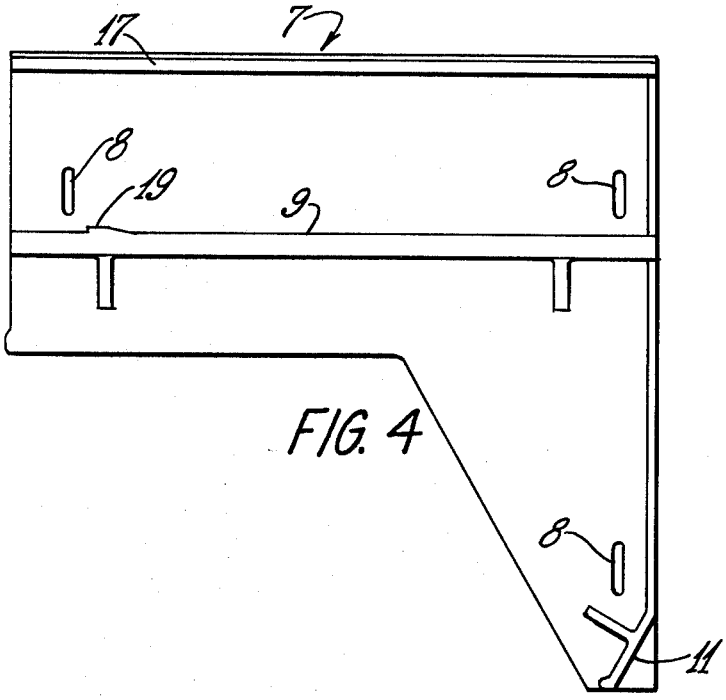
FIG. 4 is an end view of the mounting brackets.
Figure 5:
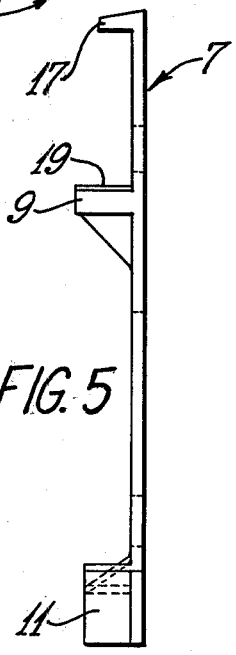
FIG. 5 is a front view of the mounting bracket.
Figure 6:
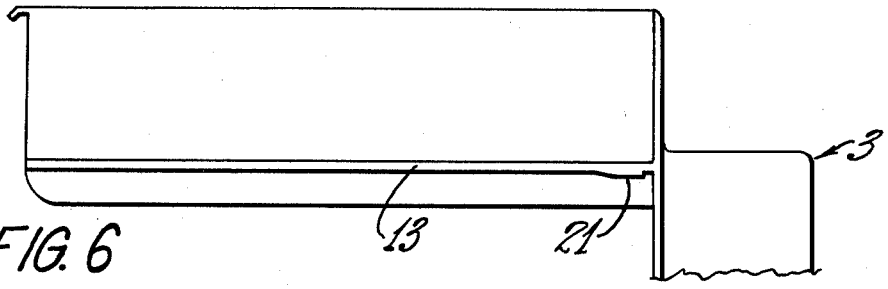
FIG. 6 is a partial end view of the vanity member that shows the support portion of the vanity member.

FIGS. 4 and 5 show the mounting brackets 7 in more detail. The mounting bracket is secured to the opposed walls by using screws, nails or other suitable securement means that are driven through the slots 8 in the mounting bracket and this securely fastens the mounting bracket 7 to the walls. The slots 8 are shown as being elongated and the slots are made this way so that the mounting bracket 7 may be moved a small amount so that it is in the proper position. This can be accomplished by loosening the securement means that passes through the slots 8 and then repositioning the mounting bracket so that it is in the proper alignment and then retightening or resecuring the fastening means in the slots 8. In the lower region of the mounting bracket 7 there is the attachment surface 11 upon which the attachment portion of the vanity member is moved into pressed relationship to hold the vanity member in position on the mounting bracket 7. The attachment surface 11 extends across the lower region of a mounting bracket at an angle and the attachment surface is securely connected to the side of the mounting bracket 7. This is done to help insure that the attachment surface 11 will be strong enough to hold the vanity member in position on the mounting bracket 7 once the vanity member has been securely attached to the attachment surface 11. In approximately the center of the attachment bracket 7 there is located the support surface 9 upon which the support portion of the vanity member is positioned. FIG. 6 shows the end of the vanity member 3 and also the support portion 13 of the vanity member. In normal operation, the vanity member 3 is positioned on the mounting bracket 7 by sliding the support portion 13 of the vanity member 3 onto the support surface 9 of the mounting bracket. This must be done so that the upper surface of the vanity member is located beneath the upper leg 17 of the mounting bracket. Thus, the end of the vanity member is positioned between the support surface 9 and the upper leg 17 of the mounting bracket. When the vanity assembly 3 is the desired position on the mounting bracket 7 there should be a snug fit between the top of the vanity member and between the bottom surface of the upper leg 17 on the mounting bracket. To help achieve this snug fit small ramp 19 can be positioned at the rear edge of the support surface 9 and a small ramp 21 can be positioned at the front edge of the support portion 13. Thus, when the vanity member 3 is slid into position it will move onto the ramp 19 at the rear of the molding bracket while at the same time ramp 21 located on the front of the support portion of the vanity member will be moving onto the support surface 9. This acts to raise the vanity member, as it moves onto the ramps, so that the upper surface of the vanity member will be raised so that it is in snug pressed against relationship with the lower surface of the upper leg 17. Thus the ramps insure that a snug and generally water tight fit or joint is made to clean the upper surface of the vanity member and between the lower surface of the upper leg 17 of the mounting bracket.

To cover part of the front of the mounting bracket 7 and any gap that might exist between the mounting bracket 7 and the exterior edge of the support portion 13 the front edge of the vanity member can extend beyond the end of the support portion. This produces a lip or ledge along the side of the vanity member that will cover the interface between the vanity member and the mounting bracket. This is very helpful since there can be a small gap between the end of the support portion of the vanity and the portion of the mounting bracket that is positioned against the wall. This gap can exist because the distance between the mounting brackets and the length of the vanity member cannot be exactly the same in all cases. Therefore, a small clearance gap will occasionally exists. However, this gap is not always aesthetically pleasing so a lip or ledge on the front of the vanity member can be used to cover any such irregularities. The lip or ledge on the front of the vanity member can also be used to compensate for some unsquareness of the room. Usually the walls of a room are not completely square, plump or straight. Therefore, small gaps or other irregularities may appear when the vanity member is mounted on the mounting brackets. The lip or ledge on the vanity member, since it covers the front of the mounting bracket, can be used to conceal or cover most of these gaps and irregularities due to the unsquare nature of the walls of the room. The upper leg 17 of the mounting bracket also helps to cover these irregularities as it extends over the top surface of the vanity member. The portion of the upper leg 17 that extends over the top surface of the vanity member will usually cover or conceal the gaps and irregularities that exist, between the vanity member and the mounting bracket, due to the unsquare nature of the room. The lip or ledge can also be used to form a snug relatively water tight fit between the front of the mounting bracket and the front of the vanity member.

Normally the mounting bracket 7 will be constructed so that the supporting surface 9 is generally horizontal when the bracket is postioned properly on the walls. This helps to make the mounting bracket easy to install as this type of alignment is fairly easy to achieve with a level. The support portion 13 of the vanity member is also usually in a generally horizontal position when the vanity member is properly positoned. Thus, it is easy to achieve the proper alignment by placing the support portion 13 on the generally horizontal support portion 9 of the mounting bracket. If the supporting surfaces 9, on each of the mounting brackets, are at the same elevation then the vanity member 3 will be properly positoned. Thus, this is a fairly easy way to install the vanity and lavatory assembly previously described. However, it should be noted that the support surface of the mounting bracket and the support portion of the vanity member can be in almost any configuration or plane and the concept will still work. However, it is believed that horizontal support surfaces and support portions will work best in most installations and that this will usually be the easiest way to make and install the mounting brackets and vanity member. The mounting brackets 7 can also be constructed so that the vanity member 3 can be positioned completely over towards one mounting bracket when the vanity member is being slid in place. This can be accomplished by providing slots or notches in the top of the mounting bracket that allow the vanity member to be moved over against one of the mounting brackets. It should be noted that the vanity member is still between and in contact with both of the mounting brackets while it is moved over as close as possible to one of the mounting brackets. The vanity member is moved over towards one of the mounting brackets so that an obstruction, such as a door frame or other similar features, does not prevent the vanity member from being slid into position. Thus, this feature allows for some compensation to avoid obstructions or obstacles when installing the vanity member.

In the previous description the vanity member is shown as being one piece with a lavatory contained therein. In practice it has been found that this vanity member can best be made out of a glass fiber reinforced plastic material with the lavatory molded into the vanity member. However, the vanity member could be made from other suitable materials. Also the vanity member could be made from more than one piece and the lavatory could be a separate piece that is installed into the vanity member. The lavatory could then be installed into the vanity either before or after the vanity member is placed in position on the mounting brackets. A back splash or raised portion on the back of the vanity member could be added to the vanity member to protect the rear wall from being splashed. The back splash could be molded into the vanity to produce a one piece unit or the back splash could be a separate piece. The back splash could be made from glass fiber reinforced plastic or any other suitable material.

Since the vanity member slides into the mounting brackets it is relatively easy to install the vanity if everything is properly aligned. Since the mounting brackets are held in place by a few screws or nails they can be easily and quickly positioned on the opposed walls where the vanity is to be mounted. Once the mounting brackets are in place it is a relatively easy job to slide the vanity member into place on the mounting brackets. Then a simple spring clip can be installed to the attachment surface and attachment portion to hold the vanity member in position. Since the spring clip is removable the vanity member can easily be removed by removing the spring clip and sliding the vanity out of the mounting bracket. Thus, the vanity member is almost as easy to remove for repair or replacement as it is to install. The easy movement of the vanity also allows for improved access to the plumbing for the lavatory as the vanity can be moved or removed, if necessary, to gain better access to the plumbing. Further, since the mounting brackets and vanity can be installed against walls that have already been finished it will be easier to coordinate the work of the plumbers and carpenters. The plumber can install the rough plumbing in the room, then the carpenters can finish the walls of the room and the plumber can return to install the vanity and to connect the finished plumbing for the vanity which can also be installed in a convenient place away from the room in which the vanity is to be installed. This reduces the interaction between the plumbers and carpenters on installing the vanity and increases the efficiency of the installation.

Having described the invention in detail and with reference to particular materials, it will be understood that such specifications are given for the sake of explanation. Various modifications and substitutes other than those cited may be made without departing from the scope of the invention as described by the following claims.

We claim:

1. A vanity and lavatory assembly adapted to be secured to two opposing walls of a room comprising:

a vanity member having a lavatory located at a first surface and a support portion and an attachment portion oriented substantially transverse to said first surface and spaced from said first surface at each lateral end of said vanity member, said support portions each having a lower surface with a raised portion located thereon;

a pair of mounting brackets each adapted to be secured individually to one of the opposing walls, each of said brackets having an upper leg and a lower leg projecting from the surface of the bracket in a direction normal to the surface of the opposed walls and adapted to accomodate the vanity member therebetween and each mounting bracket further including an attachment surface, each of said lower legs having a raised ramp thereon, the raised portion at each end of the vanity member and said ramps of the brackets being adapted to position the vanity member in pressed relationship against said upper legs of each of said brackets, said attachment portions of the vanity member and said attachment surfaces being oriented for individual engagement to locate the vanity member with respect to the brackets; and means for securing the attachment portion to the attachment surface.

2. The assembly of claim 1 wherein said ramps and raised portions are adapted to move said vanity member toward said upper legs as the vanity member is being slid between said upper and lower legs of the brackets.

3. The assembly of claim 2 wherein said raised portions have a ramped shape.

4. The assembly of claim 3 wherein each of said ramps of said brackets are located at the end of said respective bracket opposite the end of the bracket at which said vanity member is adapted to enter.

5. The assembly of claim 4 wherein said raised portions are positioned on the vanity member to engage said lower legs of said brackets at the end of such brackets opposite the end at which said ramp is located.

6. The assembly of claim 5 wherein the vanity member and the brackets are comprised of a glass fiber reinforced material.

7. The assembly of claim 6 wherein said means for securing the attachment portion to the attachment surface is a removable clip.

* * * * *